United States Patent [19]

Windom

[11] 4,217,628

[45] Aug. 12, 1980

[54] ELECTRICAL LIGHTING SYSTEM FOR ROTATING CHAIR

[76] Inventor: Kenneth R. Windom, 4200 Santo-Tomas Dr., #D, Los Angeles, Calif. 90008

[21] Appl. No.: 893,046

[22] Filed: Apr. 3, 1978

[51] Int. Cl.[2] ..... A47C 7/72

[52] U.S. Cl. ..... 362/75; 362/131; 362/364; 339/8 R

[58] Field of Search ..... 362/61, 73, 74, 75, 362/131, 364; 339/1 R, 6 R, 8 R, 2 A

[56] References Cited

U.S. PATENT DOCUMENTS

| | | | |
|---|---|---|---|
| 1,189,565 | 7/1916 | Hartsaw | 339/8 R |
| 1,924,101 | 8/1933 | Batrack et al. | 362/61 |
| 2,514,322 | 7/1950 | Flogaus | 362/75 |
| 3,208,031 | 9/1965 | Dickson | 362/61 |
| 3,800,430 | 4/1974 | Samra | 362/61 |

*Primary Examiner*—Monroe H. Hayes

*Attorney, Agent, or Firm*—Romney, Schaap, Golant, Disner & Ashen

[57] ABSTRACT

A lighting system for installation in a swivel chair of the type commonly found in van vehicles. The system is to display the van owner's CB "handle" or code designation and includes a bracket, attached insulated box, a nested metal container to which is mounted three bulbs and a cover with a light diffuser. The handle is painted or silked screened on the diffuser and is positioned to be seen from outside the vehicle. The system also includes an electrical connector which is used to complete an electrical circuit without interfering with the rotation of the chair.

3 Claims, 7 Drawing Figures

FIG. 1.
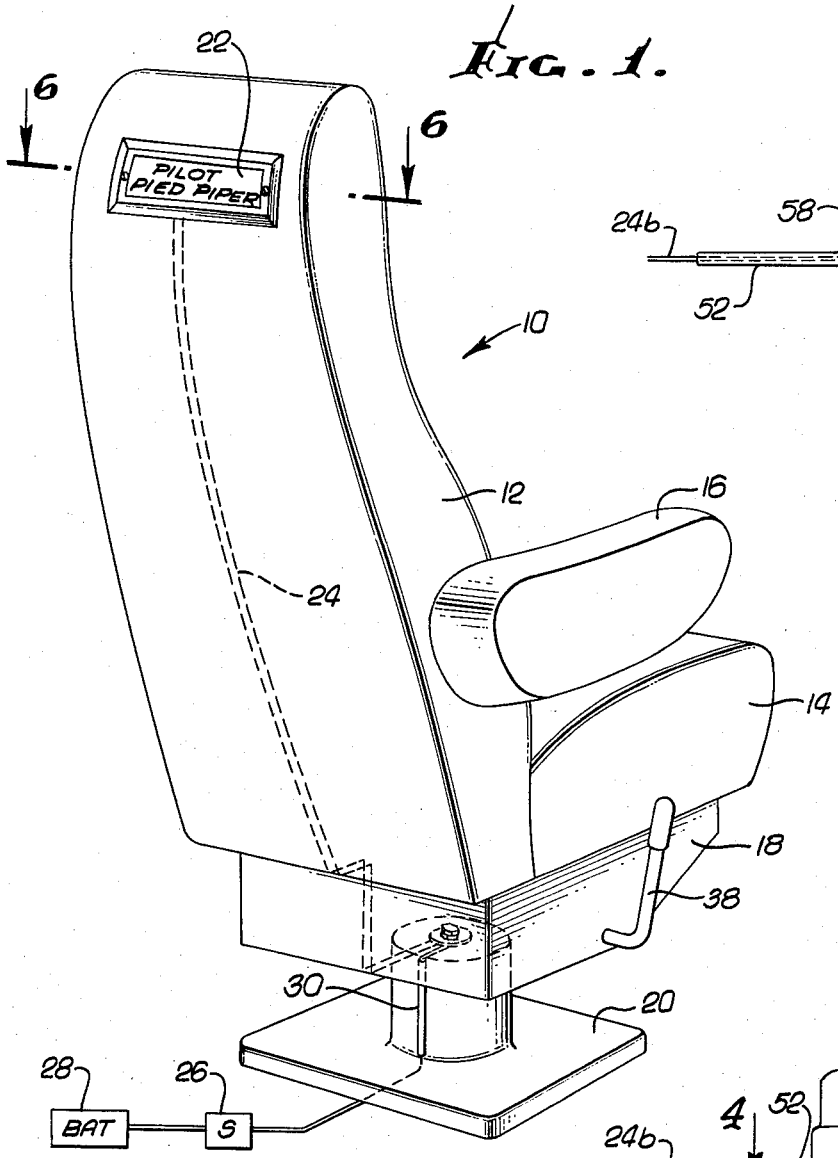
FIG. 4.
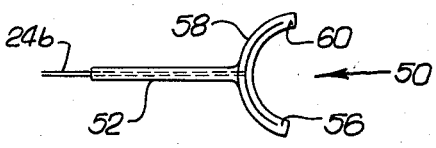
FIG. 3.
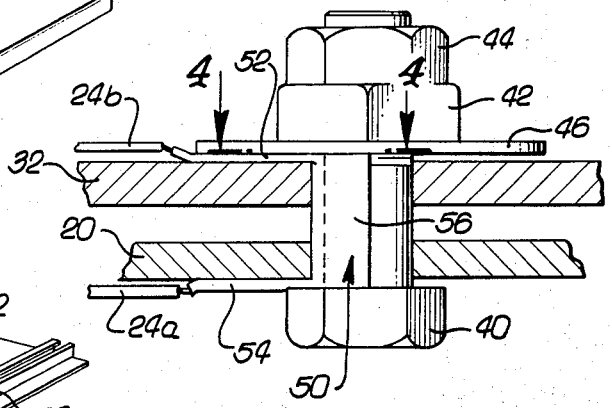
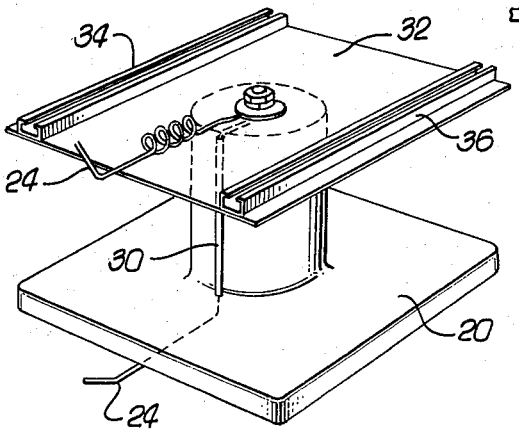
FIG. 2.

ELECTRICAL LIGHTING SYSTEM FOR ROTATING CHAIR

BACKGROUND OF THE INVENTION

1. Field of the Invention

The present invention relates to an electrical lighting system, and more particularly, to an electrical lighting system for use with a rotating or swivel high back vehicle chair like that commonly found in van-type vehicles.

2. Description of the Prior Art

There has been a substantial increase in the popularity of van-type vehicles as a replacement for the traditional station wagon and for use as small mobile camping homes. In addition, there has been a complementing increase in the popularity of CB type radios which are installed in vehicles. Inherent in the use of CB radios is the adoption of a coded designation for the user; this designation is commonly called the users "handle".

With the advent of the "handle", there has developed a desire to advertise to other people having vehicles with CB radios what one's handle is. This has taken the form of decals on windows or painted letters on the side of the vehicle. In addition, special lighted displays exist which mount to the vehicle body. A drawback to the above-mentioned devices include undue expense, lack of visibility, or in the case of paint an un-needed permanency.

SUMMARY OF THE INVENTION

The present invention has solved the problems set forth above by providing a lighting system comprising a mounting bracket adapted to be attached to a chair; a supporting insulated box connected to the bracket, means mounted to the supporting box for supporting a light source; and cover means removably connected to the light source supporting means for diffusing light from the light source.

An aim of the present invention is to provide a simply constructed reliable and relatively inexpensive lighting system for use with a van-like vehicle. Another aspect of the present invention is to provide a lighting system for indicating a CB designation which may be readily viewed from outside the vehicle to which the lighting system is attached. Still another object of the present invention is to provide a CB handle lighting system which is easy to install either as original equipment or as an add-on.

The foregoing objects, advantages, features and results of the present invention together with various other object, advantages, features and results thereof which will be evident to those skilled in the art in light of this disclosure may be achieved with the exemplary embodiment of the invention described in detail hereinafter and illustrated in the accompanying drawings.

BRIEF DESCRIPTION OF THE DRAWINGS

FIG. 1 is a perspective view of the back of a rotating chair such as those commonly found in van-type vehicles. Also illustrated in diagrammatic form is the vehicle battery and a switch.

FIG. 2 is a perspective view of a mounting stand and mounting seat plate to which the chair of FIG. 1 is attached.

FIG. 3 is an enlarged view of a bolt, nut and washer connection between the mounting stand and the mounting seat plate and including an electrical connector.

FIG. 4 is a plan view of the electrical connector taken along line 4—4 of FIG. 3.

DESCRIPTION OF THE PREFERRED EMBODIMENT

Figure 5:
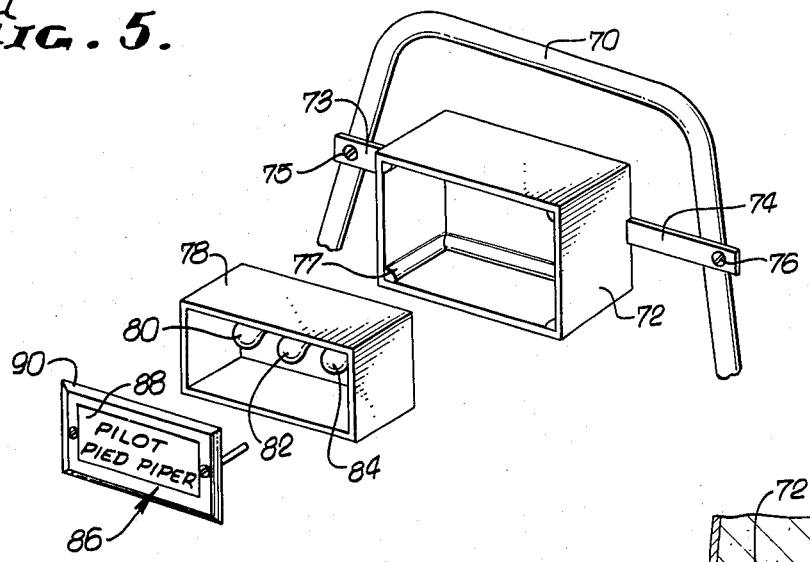
FIG. 5 is an exploded prespective view of a portion of the lighting system.

While the present invention is susceptible of various modifications and alternative constructions, an embodiment is shown in the drawings and will herein be described in detail. It should be understood, however, that it is not the intention to limit the invention to the particular form disclosed; but, on the contrary, the invention is to cover all modifications, equivalencies and alternative constructions falling within the spirit and scope of the invention as expressed in the appended claims.

Referring now to FIG. 1 there is illustrated a van-type rotating or swivel chair 10 having a back portion 12, a seat portion 14 and an arm 16. The chair is mounted to a base 18 which in turn is supported by a mounting stand 20. Mounted in the back portion of the chair is a lighted display 22 for indicating the "handle" of the van owner.

In diagrammatic form the electrical wiring 24 extends from the lighted display 22 down the back portion of the chair along the mounting stand 20 to the head light switch 26 and in the usual manner to a power source such as the vehicle's battery 28.

Referring now to FIG. 2, there is illustrated in more detail the manner in which the chair 10 is mounted to allow rotation. The mounting stand is usually directly bolted to the floor of the vehicle. A tube 30 is provided to provide a defined path for the electrical wiring 24. Connected to the mounting stand is a mounting seat plate 32 which includes parallel rails 34 and 36. The seat 10 is mounted to the rails and by operation of the lever 38, FIG. 1, the seat the seat may be moved in a linear manner toward and away from the steering wheel (not shown) of the vehicle. Located between the plate 32 and the stand 20 is a bearing (not shown) to support the chair and also facilitate its rotational movement.

Emphasizing the advantages of simple construction, inexpensiveness and reliability, reference is made to FIGS. 3 and 4 which illustrate the manner in which the chair is mounted to the stand to allow rotational movement while at the same time providing for an electrical connection to be made without interfering with this rotational movement. The stand 20 and the plate 32 are connected by a bolt 40 passing through aligned openings in the stand and the plate and fastened by two nuts 42 and 44 which ride upon a washer 46. As can be seen there is a connector 50 which communicates the lower wiring **24*a* with the upper wiring 24*b*. The connector includes an upper arm 52 which is connected to upper wiring 24*b* and a lower arm 54 which is connected to the lower wiring 24*a*. Each of the arms extend from a body 56. The interior of the connector comprises an electrically conductive material such as a suitable metal 58 while the exterior of the connector is of an electrically insulative material such as a suitable synthetic resin 60**.

Figure 7:
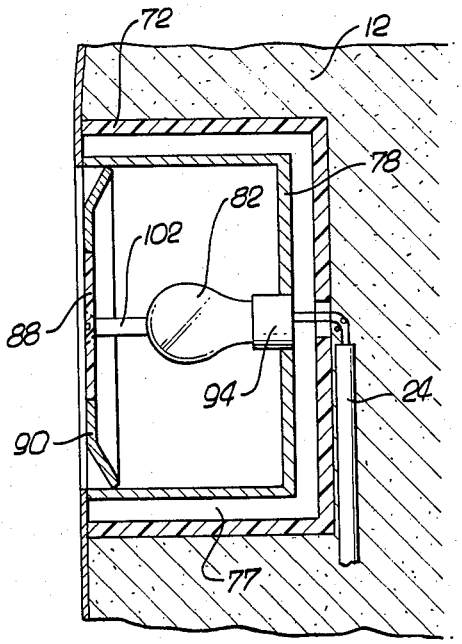
FIG. 7 is a sectional elevational view taken along line 7—7 of FIG. 6.
Figure 6:
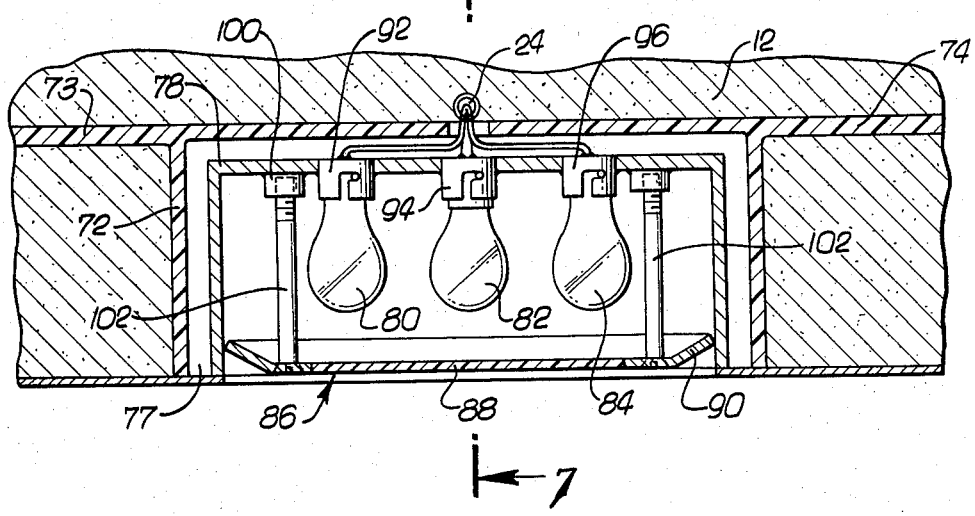
FIG. 6 is an enlarged sectional plan view taken along line 6—6 of FIG. 1.

Also emphasizing the advantages of the invention in terms of simplicity of construction, reliability and inexpensiveness, reference is made to FIGS. 5, 6 and 7.

Mounted in the chair is a generally U-shaped bracket 70 to which is mounted an insulated box 72 made of a suitable insulative material. The box 72 is mounted to the bracket by two arms 73 and 74 and two fasteners 75 and 76. Positioned along the lateral and transverse intersections of the walls of the box are fillet beads such as a bead 77. Positioned to be placed in the insulated box 72 and be supported by the beads is a supporting reflector container 78 for mounting a light source such as the light bulbs 80, 82 and 84. Placed over the bulbs is a cover 86 which includes a light diffuser pane 88 and a frame 90. As can be seen from FIG. 6 the light bulbs 80, 82 and 84 are mounted in automotive type sockets 92, 94 and 96 respectively which are attached to the electrical wiring 24. Mounted to the interior wall of the box 78 are two threaded nuts 100 and 101 which are fixed to the box for receiving the ends of two screw bolts 102 and 103 which in turn fasten the cover 86 to the container 78.

To install the device either as an original piece of equipment or as an add-on, two holes are drilled in the bracket 70. The arms 73 and 74 are fixed to the bracket by fasteners 75 and 76. The reflector container 78 is then mounted within the box 72, the wiring 24 is connected to the sockets 92, 94 and 96, and the light bulbs are installed. After the appropriate upholstery is installed the cover is mounted.

In operation the headlight on-off switch may be used for manually lighting the bulbs to cause illumination of the "handle" which is painted or silk screened on the diffuser pane 88. By placing the system at the upper portion of the chair back portion other drivers will be able to visually determine the handle and make verbal contact by CB radio.

What is claimed is:

1. A lighted identification system for incorporation with a chair comprising:

(a) a swivel chair having a back portion and a seat portion, said chair being of the type having a high styled back as often used on van-type vehicles;

(b) a lighted display mounted in the back portion of said chair;

(c) a base for said chair, including a mounting seat plate, said seat portion of said chair being linearly movable relative to said mounting seat plate and said stand having an opening;

(d) a mounting stand connected to said base, said stand adapted to be attached to the floor of the vehicle, and having an opening alignable with the opening in said base;

(e) a tube connected in a generally vertical disposition to said mounting stand;

(f) a bolt positioned through said opening in the stand and the base for rotatably connecting said chair and stand;

(g) a nut attached to said bolt;

(h) a washer positioned about said bolt and located between said nut and said plate;

(i) a connector including an electrically conductive element embedded within an insulative synthetic resin, said connector having upper and lower arms and an arcuate body being somewhat less than semi-cylindrical whereby an electrically conductive path may be formed between the lighted display and the power source while allowing said chair to swivel;

(j) a first electrical conductor disposed between said lighted display and said connector and located within the back portion of said chair; and (k) a second electrical conductor disposed between said connector and a power source, said second conductor positioned through said tube.

2. A lighted identification system as claimed in claim 1, including:

a pair of parallel rails attached to said plate which allows linear chair motion.

3. A lighted identification system as claimed in claim 1 wherein:

said chair includes a U-shaped support bracket in the back portion; and said lighted display includes:

(a) a rectangular insulated box having four side walls and a back wall and forming an interior space;

(b) two laterally extending arms attached to two of said side walls of said box, said arms being fastened to said U-shaped brackets;

(c) two oppositely disposed U-shaped fillet beads disposed within the interior space of said box in which the arms of the U are situated along an intersection of two side walls and the base of the U is situated along an intersection between a side wall and the back wall of said box;

(d) a rectangular reflector container having four side walls and a back wall, said back wall supporting at least one light source and two threaded elements;

(e) at least one socket mounted to said container;

(f) a light source mounted to each socket;

(g) a light diffuser pane;

(h) a frame attached to said light diffuser pane, having two openings; and (i) two elongated screw bolts received by said openings and threadedly engaged with said two threaded elements.

* * * * *